United States Patent [19]

Tudor et al.

[11] Patent Number: 4,773,531

[45] Date of Patent: Sep. 27, 1988

[54] CIGARETTE CARTON WITH PACKAGE SEPARATOR AND PACKAGE SPACER THEREFOR

[75] Inventors: Thomas T. Tudor, Crestwood; Chris P. Radley, Louisville, both of Ky.

[73] Assignee: Brown & Williamson Tobacco Corporation, Louisville, Ky.

[21] Appl. No.: 65,547

[22] Filed: Jun. 24, 1987

[51] Int. Cl.[4] ..... B65D 5/48

[52] U.S. Cl. ..... 206/256; 206/271; 229/120.02; 229/DIG. 5

[58] Field of Search ..... 206/256, 814, 815; 229/DIG. 5, 120.02, 120.24, 120.37

[56] References Cited

U.S. PATENT DOCUMENTS

| | | | |
|---|---|---|---|
| 1,873,557 | 8/1932 | Davis | 206/815 X |
| 2,989,174 | 6/1961 | Wurman | 206/256 |
| 3,246,740 | 4/1966 | Guyer | 206/815 X |
| 3,489,272 | 1/1970 | Rosen | 206/256 |
| 3,536,246 | 10/1970 | Rosen | 206/256 X |
| 3,596,758 | 8/1971 | Phillips, Jr. | 206/256 |
| 3,721,335 | 3/1973 | Grant | 206/256 |
| 3,727,826 | 4/1973 | Shepherd | 229/DIG. 5 |
| 3,752,308 | 8/1973 | Begemann | 206/256 |
| 4,007,836 | 2/1977 | Getz et al. | 229/DIG. 5 |

*Primary Examiner*—Jimmy G. Foster
*Attorney, Agent, or Firm*—Charles G. Lamb

[57] ABSTRACT

A cigarette carton and a cigarette carton spacer for spacing and protecting smaller than standard size cigarette packs in a standard size cigarette carton. A single or plurality of spacers can be used depending upon the size of the undersized packs to be installed in the standard size carton. At least one spacer is installed to extend longitudinally along the centerline of the carton between adjacent rows of the packs in the carton. The spacer is an elongated rectangular panel of single wall corrugated board having a length dimension corresponding to the length dimension of the interior of the carton and a width dimension corresponding to the height dimension of the interior of the carton. Each longitudinal edge of the spacer is formed with a plurality of spaced apart finger notches open to its peripheral edge. Each finger notch along one longitudinal spacer edge is in alignment with a different one of the finger notches along the other longitudinal spacer edge. In addition, the spacer could also be formed with at least one finger notch in each of the transverse spacer edges. The flutes of the corrugated intermediate layer of the single wall corrugated board extend at an acute angle to the longitudinal edges of the spacer.

12 Claims, 3 Drawing Sheets

CIGARETTE CARTON WITH PACKAGE SEPARATOR AND PACKAGE SPACER THEREFOR

BACKGROUND OF THE INVENTION

The present invention relates to cigarette packaging, and more particularly to a carton for containing a plurality of cigarette packages.

Until recently, cigarettes have been made with a typical or standard circumferential dimension of approximately 25 mm and packaged with twenty cigarettes per pack.

Slim or thin cigarettes having a smaller circumferential dimension than the more typical or conventional cigarettes are becoming more popular. In addition, it is contemplated that fewer than twenty standard size cigarettes can be packaged in a pack. These changing preferences among smokers result in certain practical problems in reduced transverse or depth dimensions of cigarette packages. The individual cigarette packages are required to have a tax stamp applied thereto. The tax stamps are applied by stamping machines of known and conventional construction. Such machines have been designed to handle and process standard size cartons including standard size packages. It is not economically feasible to modify such stamping machines or build supplemental stamping machines for handling cartons of smaller than standard size packages. In order to use existing tax stamping machines to properly stamp the smaller packages, the packages must be spaced and oriented in the carton, otherwise, the stamps will not be properly registered on the cigarette package.

SUMMARY OF THE INVENTION

The present invention provides a spacer insert in a carton of cigarette packages to take up the space remaining in a conventionally sized carton when filled with undersized, or smaller than typical cigarette packages.

More particularly, the present invention provides a cigarette carton having an elongated interior sized for receiving a quantity of standard sized cigarette packages arranged upright therein in two co-extensive rows with each package of one row in paired side-by-side alignment and abutment with a different one of the packages of the other row, an equal quantity of undersized cigarette packages received in the elongated carton interior in two co-extensive rows with each package in one row in paired side-by-side alignment with a different one of the packages of the other row; and, a rectangular spacer insert between the two rows of cigarette packages co-extensive therewith; the spacer having a length dimension corresponding to the length dimension of the carton interior and a width dimension corresponding to the height dimension of the carton interior, each longitudinal edge of the spacer being formed with a plurality of spaced apart finger clearance notches open to the longitudinal spacer edge, the number of notches being equal to the number of cigarette packages in each row, and the centerline space between adjacent notches being equal to the distance between the centerlines of adjacent cigarette packages in each row.

A better understanding of the present invention will be had upon reference to the following description in conjunction with the accompanying drawings wherein like numerals refer to like parts through the several views and in which.

DETAILED DESCRIPTION OF THE PREFERRED EMBODIMENT

Figure 1:
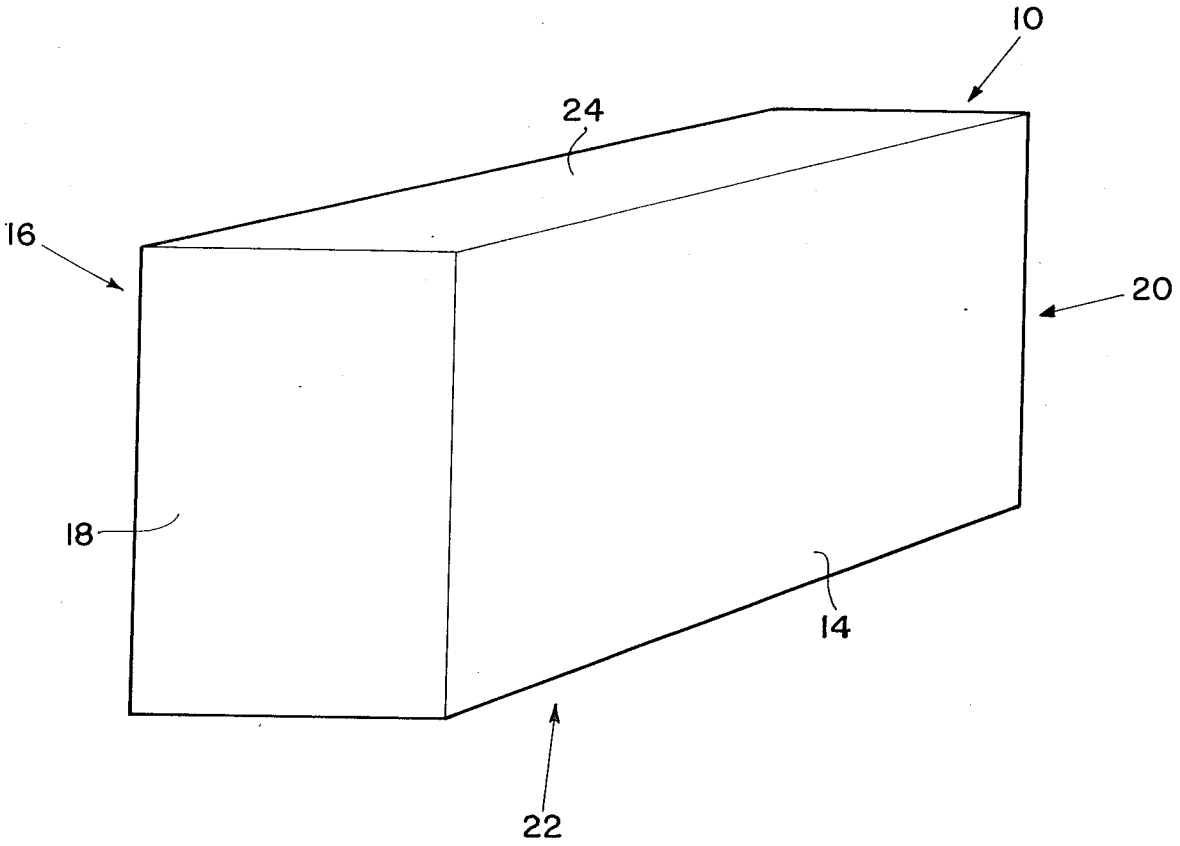
FIG. 1 is a perspective view of a carton containing a plurality of undersized cigarette packages.
Figure 2:
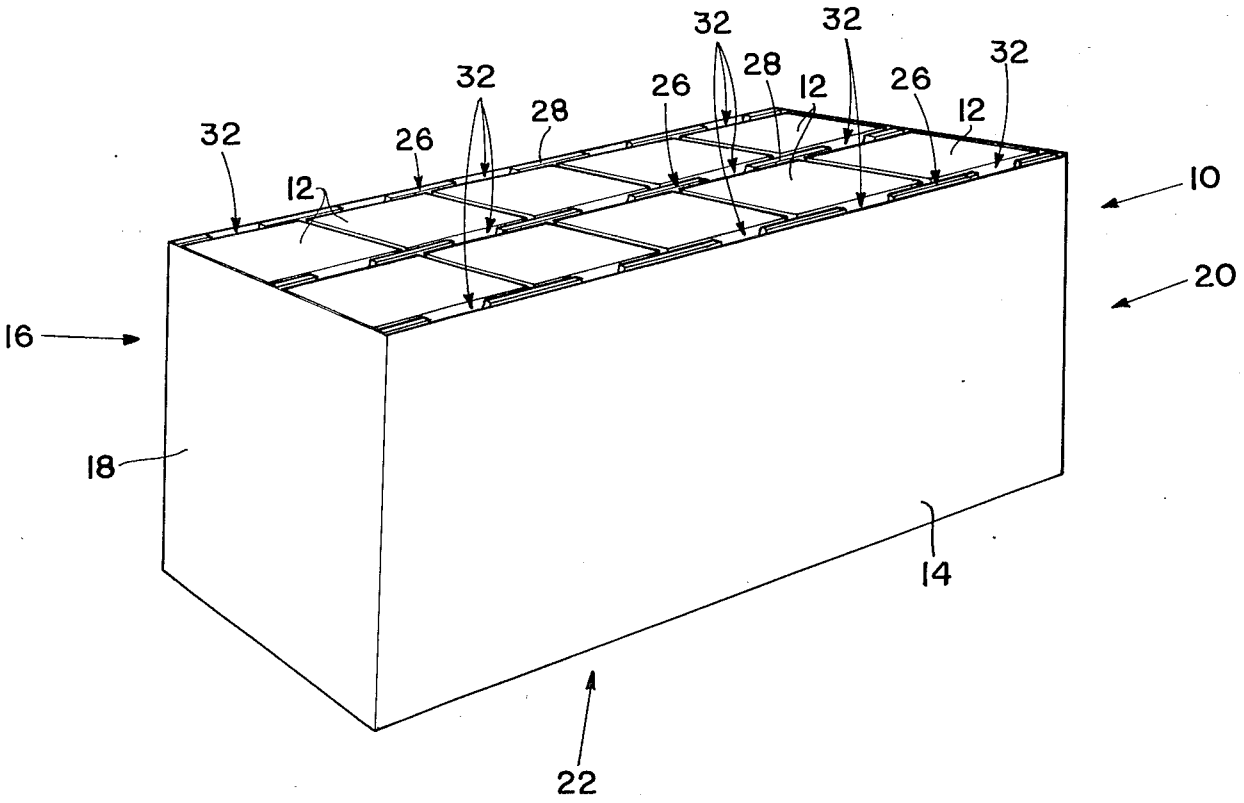
FIG. 2 is a perspective view of the cigarette carton of FIG. 1 with the top removed to show the arrangement of undersized cigarette packages and spacer inserts.

With reference to FIGS. 1 and 2, there is shown a standard size, conventional cigarette carton, generally denoted as the numeral 10. The carton 10 includes two parallel, longitudinal side walls 14 and 16, two parallel end walls 18 and 20 perpendicular to and interconnecting the side walls 14 and 16, a bottom 22 and a top 24. The carton further includes a number of undersized, or smaller than standard cigarette packages 12 equal in number to the number of standard sized packages for which the carton is sized to receive located in the elongated carton interior in two co-extensive rows. Each cigarette package 12 in one row is paired in side-by-side alignment with a different one of the cigarette packages 12 of the other row cooperating to define an elongated interior sized for receiving a quantity of standard sized cigarette packages arranged upright therein in two co-extensive rows with each package of one row in paired side-by-side alignment with a different one of the packages of the other row. The rows of cigarette packages 12 are co-extensive with the interior length of the carton 10 with one end package 12 of both rows in abutment with one end wall 18 of the carton 10 and the other end package 12 of both rows in abutment with the other end wall 20 of the carton 10.

A spacer insert 26 is located between the two rows of cigarette packages 12 in abutment with the cigarette packages 12 of each row, a second spacer insert 26 is located between one row of cigarette packages 12 and one side wall 14 of the carton 10, and a third spacer insert 26 is located between the other row of cigarette packages 12 and the other side wall 16 of the carton 10. The insert spacers 26 are of such a thickness as to fill the empty space difference between the width of the two rows of packages 12 and the width of the carton 10. The spacer inserts 26 are also of a thickness to properly, laterally space the rows of cigarette packages 12 from each other and from the side walls 14 and 16 of the carton 10 in a manner which provides for the standard tax stamp applicator device to properly mark the top end of each of the smaller than standard sized cigarette packages 12 in the carton 10.

Figure 3:
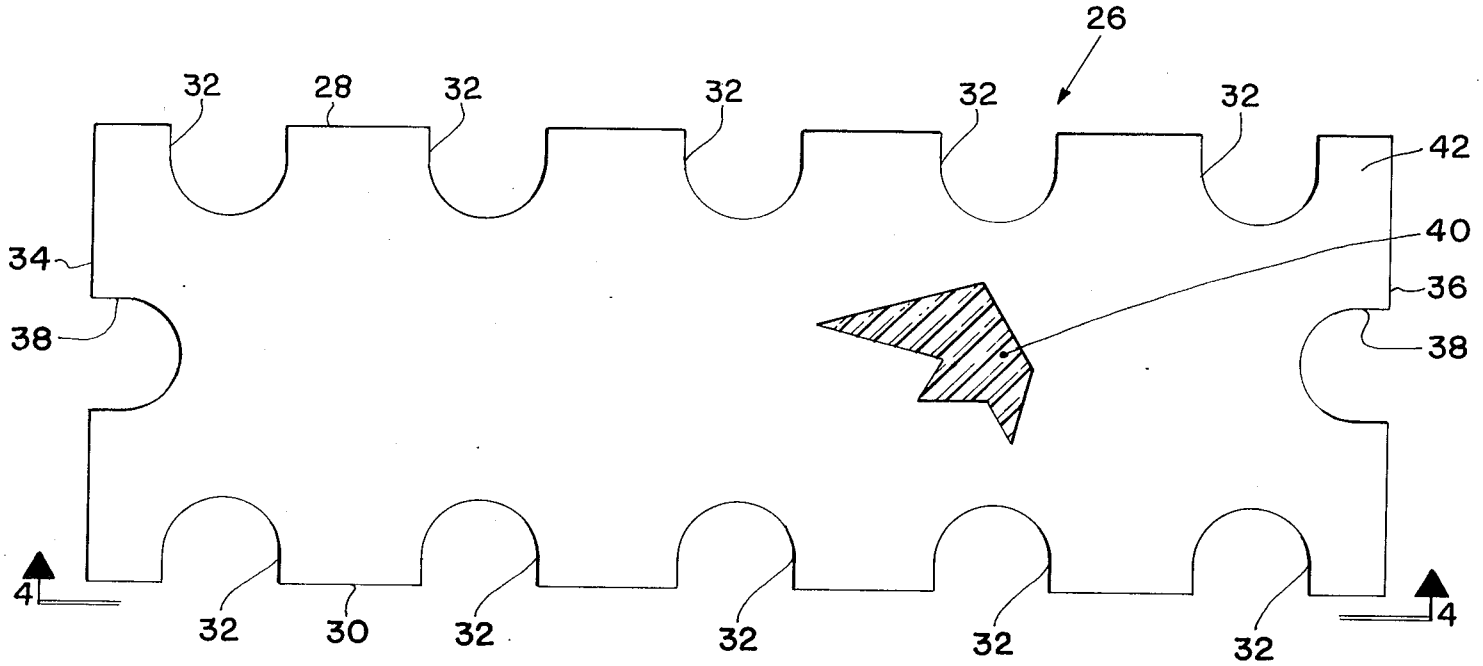
FIG. 3 is a side view of the spacer insert, partially broken away to show details of construction; and, FIG. 4 is an edge view of the insert spacer as seen in the direction of arrows 4—4 in FIG. 3.
Figure 4:
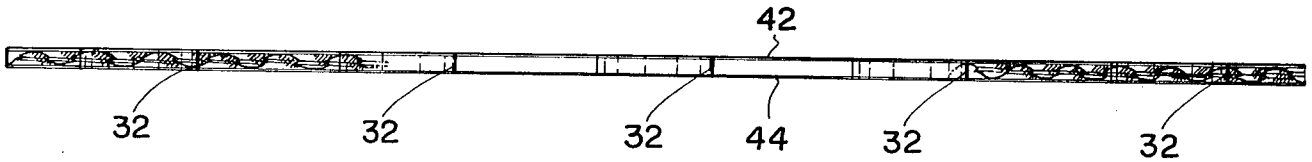

With reference to FIGS. 2 and 3, the spacer insert 26 is generally rectangular in shape having a length dimension corresponding to the interior length dimension of the carton 10 as measured between the carton end walls 18 and 20, and a width dimension corresponding to the interior height dimension of the carton as measured between the carton floor 22 and carton top 24. Each longitudinal edge 28 and 30 of the insert spacer 26 is formed with a plurality of spaced apart finger clearance notches 32 open to the longitudinal spacer edges 28 and 30. The number of finger clearance notches 32 is equal to the number of cigarette packages 12 in each row of cigarette packages, and the centerline space between adjacent notches corresponds to the centerline distance between adjacent packages 12 of each row of cigarette packages. In addition, each of the transverse edges 34 and 36, and spacer insert 26 is formed with a finger clearance notch 38 centered on the transverse edge 34, 36, and therefore, centered along the height dimension of the cigarette package 12. Thus, the insert spacer 26 is symmetrical about its longitudinal centerline "A" as well as its transverse centerline "B".

With continued reference to FIGS. 2 and 3, the insert spacer 26 is formed of a rectangular corrugated intermediate panel 40 sandwiched between co-extensive outer sheets 42 and 44. The corrugations extend diagonally across the width of the insert spacer and intersect the longitudinal edges 28 and 30 of the insert spacer at an acute angle, and also the transverse edges 34 and 36 of the insert spacer at an acute angle. The insert spacer 26 can be fabricated of virtually any convenient material such as, for example, plastic. Preferably, the intermediate panel 40 is fabricated of corrugated medium, and the outer sheets 42 and 44 of linerboard and glued to the ridges of the corrugations. The corrugations extending diagonally across the width of the spacer insert 26 provide a resistance to bending of the spacer insert both transversely and longitudinally of the spacer insert 26 resulting in a very strong carton 10. However, it is contemplated that the spacer insert 26 can be fabricated of just the single wall corrugated intermediate panel 40 by eliminating the outer sheets 42 and 44.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A cigarette carton comprising:

two spaced parallel longitudinal side walls, two space parallel end walls perpendicular to and interconnecting the side walls, a bottom and a top cooperating to define an elongated interior sized for receiving a quantity of standard sized cigarette packages arranged upright therein in two co-extensive rows with each package of one row in paired side-by-side alignment and abutment with a different one of the packages of the other row;

an equal quantity of smaller than standard size cigarette packages received in the elongated carton interior in two co-extensive rows with each package of one row in paired side-by-side alignment with a different one of the packages of the other row; the rows of cigarette packages being co-extensive with the interior length of the carton with the package being co-extensive with the interior length of the carton with the package at one end of each row in abutment with one carton end wall and with the package at the other end of each row in abutment with the carton end wall;

a first elongated, rectangular spacer insert disposed between the two rows of smaller than standard sized packages co-extensive with the two rows of packages, the spacer having a length dimension corresponding to the length dimension of the carton interior and a width dimension corresponding to the height dimension of the carton interior; and, at least one longitudinal edge of the spacer insert is formed with a plurality of spaced finger clearance notches open to the longitudinal spacer insert edge, the number of notches being equal to the number of smaller than standard size packages in each row of packages.

2. The cigarette carton of claim 1, wherein the centerline space between adjacent notches of the spacer are such that each notch is positioned adjacent the two cigarette packages of a different one of the paired cigarette packages.

3. The cigarette carton of claim 1, wherein the spacer insert further comprises each longitudinal edge of the spacer being formed with a like plurality of spaced apart finger clearance notches, the notches being open to the longitudinal edge in which it is formed, and each notch in one longitudinal edge being aligned with a different one of the notches in the other longitudinal edge across the width of the spacer insert.

4. The cigarette carton of claim 1, wherein the spacer insert further comprises a finger clearance notch formed in each transverse end of the spacer insert.

5. The cigarette carton of claim 1, wherein the spacer insert comprises a single wall corrugated panel.

6. The cigarette carton of claim 5, wherein the flutes of the spacer insert panel extend diagonally across the width of the panel and intersecting the longitudinal edges at an acute angle.

7. The cigarette carton of claim 5, wherein the spacer insert further comprises two outer sheets co-extensive with the corrugated medium and sandwiching the corrugated medium therebetween, the outer sheets being affixed to the ridges of the corrugated panel.

8. The cigarette carton of claim 1, further comprising:

a second elongated, rectangular spacer insert identical to the first spacer insert disposed between one row of cigarette packages and one longitudinal carton side wall; and, a third elongated rectangular spacer insert identical to the first spacer insert disposed between the other row of cigarette packages and the other longitudinal carton side wall.

9. A rectangular spacer insert in combination with a cigarette carton for spacing adjacent rows of cigarettes in the carton comprising:

an intermediate rectangular corrugated board panel having flutes extending diagonally across the width of the spacer insert and intersecting the longitudinal edges thereof at an acute angle; and, a pair of outer sheets sandwiching the corrugated board panel therebetween, the outer sheets being co-extensive with the intermediate corrugated panel and being affixed to the ridges of the corrugated panel; and, at least one longitudinal edge of the spacer insert being formed with a plurality of spaced finger clearance notches open to the longitudinal edge of the spacer insert.

10. The rectangular spacer insert of claim 9, further comprising each longitudinal edge of the spacer insert being formed with a like plurality of spaced apart clearance notches, the notches being open to the longitudinal edges in which it is formed, and each notch in one longitudinal edge being aligned with a different one of the notches in the other longitudinal edge across the width of the spacer insert.

11. The rectangular spacer insert of claim 9, further comprising each transverse edge of the spacer insert being formed with a finger clearance notch open to the transverse edge in which it is formed.

12. The rectangular spacer insert of claim 11, wherein the finger clearance notches in the transverse ends of the spacer insert are in alignment with each other.

* * * * *